US012241174B2

(12) United States Patent
Xu et al.

(10) Patent No.: US 12,241,174 B2
(45) Date of Patent: Mar. 4, 2025

(54) METHOD AND DEVICE FOR INDUCED LOCALIZED ELECTRODEPOSITION ON BACK SIDE OF THIN-WALLED WORKPIECE THROUGH LASER IRRADIATION

(71) Applicant: JIANGSU UNIVERSITY, Zhenjiang (CN)

(72) Inventors: Kun Xu, Zhenjiang (CN); Zhihao Leng, Zhenjiang (CN); Yangfan Tang, Zhenjiang (CN); Sheng Guo, Zhenjiang (CN); Zhaoyang Zhang, Zhenjiang (CN); Hao Zhu, Zhenjiang (CN); Yang Liu, Zhenjiang (CN); Yucheng Wu, Zhenjiang (CN); Wenhui Liang, Zhenjiang (CN); Panzhou Li, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 18/009,344

(22) PCT Filed: May 31, 2022

(86) PCT No.: PCT/CN2022/096163

§ 371 (c)(1),
(2) Date: Dec. 9, 2022

(87) PCT Pub. No.: WO2023/284431

PCT Pub. Date: Jan. 19, 2023

(65) Prior Publication Data

US 2024/0229283 A1 Jul. 11, 2024

(30) Foreign Application Priority Data

Jul. 15, 2021 (CN) ..... 202110799131.0
Apr. 29, 2022 (CN) ..... 202210467458.2

(51) Int. Cl.

| | |
|---|---|
| ***C25D 5/08*** | (2006.01) |
| ***C25D 5/00*** | (2006.01) |
| ***C25D 5/02*** | (2006.01) |
| ***C25D 5/18*** | (2006.01) |
| ***C25D 17/10*** | (2006.01) |

(52) U.S. Cl.

CPC ..... *C25D 5/67* (2020.08); *C25D 5/024* (2013.01); *C25D 5/028* (2013.01); *C25D 5/08* (2013.01); *C25D 5/18* (2013.01); *C25D 17/10* (2013.01)

(58) Field of Classification Search

None

See application file for complete search history.

(56) References Cited

U.S. PATENT DOCUMENTS 5,292,418 A * 3/1994 Morita ..... C25D 5/024 204/224 R
6,467,213 B1 * 10/2002 Schlenkert ..... C25D 5/50 42/78

(Continued)

FOREIGN PATENT DOCUMENTS

CN 102817051 A 12/2012
CN 109735883 A 5/2019

(Continued)

OTHER PUBLICATIONS

English translation DE4402687 (Year: 1994).*

(Continued)

*Primary Examiner* — Stefanie S Wittenberg

(74) *Attorney, Agent, or Firm* — Bayramoglu Law Offices LLC

(57) ABSTRACT

A method used to repair a workpiece through a combination of laser and an electrochemical reaction is provided. A tool anode is arranged on the back side of the workpiece and is spaced therefrom. A laser beam is focused on an outer surface of the workpiece to realize localized repairing on the (Continued)

back side. The method realizes localized coating repairing on the back side of the workpiece through coordination between the thermal effect of the laser and the electrochemical deposition based on the characteristic of high thermal conductivity of the workpiece. The electrodeposition reaction does not occur in regions that do not need to be repaired. The operating process is simple, the cost of the plating solution is largely reduced, and the problem that the coating on the inner wall of the thin-walled workpiece is difficult to repair due to stripping is solved.

4 Claims, 10 Drawing Sheets

(56) References Cited

U.S. PATENT DOCUMENTS

| | | | | |
|---|---|---|---|---|
| 2009/0081386 | A1* | 3/2009 | Von Gutfeld | C25D 5/50 118/58 |
| 2011/0037824 | A1 | 2/2011 | Usami | |

FOREIGN PATENT DOCUMENTS

| | | | |
|---|---|---|---|
| CN | 112126955 | A | 12/2020 |
| CN | 112176383 | A | 1/2021 |
| CN | 109735883 | B | 2/2021 |
| CN | 113481555 | A | 10/2021 |

OTHER PUBLICATIONS

Yucheng Wu, et al., Effect of Laser Single Pulse Energy on Micro-structural, Mechanical and Corrosion Properties of Amorphous Ni—Fe—P Alloy Prepared by Laser-Assisted Electrodeposition, Surfaces and Interfaces, 2021, pp. 1-8, vol. 22, 100811.

Nie Xin, et al., Influence of Pulsed Laser Shock Effect on Grain and Its Surface Morphology of Locally Electrodeposited Copper, Chinese Journal of Lasers, 2017, pp. 0402013-1-0402013-7, vol. 44, No. 4.

* cited by examiner

METHOD AND DEVICE FOR INDUCED LOCALIZED ELECTRODEPOSITION ON BACK SIDE OF THIN-WALLED WORKPIECE THROUGH LASER IRRADIATION

CROSS REFERENCE TO THE RELATED APPLICATIONS

This application is the national phase entry of International Application No. PCT/CN2022/096163, filed on May 31, 2022, which is based upon and claims priority to Chinese Patent Applications No. 202110799131.0 filed on Jul. 15, 2021, and No. 202210467458.2 filed on Apr. 29, 2022, the entire contents of which are incorporated herein by reference.

TECHNICAL FIELD

The present disclosure relates to the field of surface machining in non-traditional machining technologies, and in particular, to a hybrid laser-electrochemical machining method and device which are suitable for quick repairing through localized electrodeposition of workpieces such as tubes, hollow shafts, and thin-walled mold cavities that have inner surfaces difficult to machine.

BACKGROUND

In recent years, surface coating technologies have played an important role in the fields of national defense, machinery, aerospace, chemical industry, and so on. Electroplated coatings with good service performances in terms of wear resistance, corrosion resistance, hardness, and the like are widely applied on inner walls of parts in the shape of tubes, shafts, and so on. The mechanical friction, plugging and unplugging, corrosion, and other factors will cause losses to the parts under extreme conditions, and the coatings on the inner walls are prone to partial stripping and failure when subjected to high temperature, high pressure, and load extrusion, which greatly reduce the precision and service life of the parts. At present, partial coating repairing methods for parts with small hole diameters and long hole depths are mainly replacing the parts directly or deplating first and then plating the entire parts again; as a result, plenty of the plating solution is wasted and the production efficiency is affected. The hybrid laser-electrochemical technology is used for induced electrodeposition in a laser irradiated region of a substrate based on the thermal effect of the laser, and the electrodeposited coating has advantages such as high efficiency, good localization, high flexibility, and high bonding degree.

Researches have been made on the hybrid laser-electrochemical technology in and out of China. The patent with the publication number of CN102817051A discloses a laser pulse electroplating system, where laser pulses are matched with electrical signal pulses to realize the combination of laser irradiation and electrodeposition technologies, thereby effectively improving the physical and chemical properties of the coating and improving the machining efficiency and resolution of the coating. However, this invention is mainly aimed at improving the quality of the electrodeposited coating and cannot achieve the purpose of laser-induced localized electrodeposition. The patent with the publication number of CN109735883B discloses a device and a method for laser-assisted micro-electrodeposition by using a flexible follow-up tool electrode. According to this method, localization of electrodeposition and dimensional precision of members are enhanced by using the flexible follow-up tool electrode to restrict a dispersion region of an electric field and a reaction region of electrodeposition, and a complex-shaped micro-part can be deposited by controlling a motion path of the flexible follow-up tool electrode. However, in this invention, the process is complex, the motion path of the follow-up tool electrode and the laser scanning path are difficult to keep consistent, and the localization of the coating can hardly be ensured.

The conventional laser-electrochemical deposition methods are generally used for laser-enhanced electrodeposition on the surfaces of workpieces to improve the performance of existing electroplated coatings, or for laser-induced deposition at solid-liquid interfaces in laser irradiated regions. The problem of repairing the coatings on the inner walls and the back sides of the workpieces is not solved. Although a micro-tool anode can be used for localized electrodeposition of coatings and microstructures, the process is complex, precise "tool setting" of the anode and the laser focus is difficult to be achieved, and high precision of the device is required. Besides, this method is not suitable for deposition on inner walls of tubes and mold cavities.

SUMMARY

To eliminate the defects in the existing electroplating repairing technologies and localized electroplated coating preparation technologies on inner walls of workpieces, the present disclosure provides a method for repairing a back side of a material through localized electrodeposition by using a hybrid laser-electrochemical technology. In the method, laser and electrochemical technologies are combined, a tool anode is arranged on a back side of a workpiece to be repaired, and a laser beam is focused on an outer surface of the workpiece to be repaired to realize localized repairing of the inner wall.

Further, the present disclosure provides a device of performing the above repairing method. The device has a simple structure, is convenient to operate, and can implement the above method.

The present disclosure achieves the above objectives through the following technical means. A method for repairing an inner wall of a material through localized electrodeposition by using a hybrid laser-electrochemical technology is used to repair a workpiece to be repaired through a combination of laser and an electrochemical reaction, where a tool anode is arranged in a center of the workpiece to be repaired, the tool anode is spaced from the tubular workpiece, and a laser beam is focused on an outer surface of the workpiece to be repaired to realize localized repairing of an inner wall.

In this technical solution, spatial and temporal distribution of laser energy and electrochemical parameters are adjusted to implement electrodeposition on the inner surface of the workpiece to be repaired, and an electrodeposition rate is controllable, where laser single-pulse energy is 0.1 μJ to 30 μJ, a scanning speed is 10 mm/s to 2000 mm/s, a laser scanning frequency is 500 kHz to 4000 kHz, a laser scanning pitch is 10 μm to 100 μm, and a laser scanning time is 5 s to 300 s; a voltage is 1 V to 5 V, a current pulse frequency is 1 kHz to 1000 kHz, and a current density is 0.1 $A/m^2$ to 5 $A/m^2$.

In this technical solution, the workpiece to be repaired is a metal thin-walled tubular workpiece with good thermal conductivity and has a thickness of 0 to 3 mm.

In this technical solution, the tool anode and the workpiece to be repaired are rotatable relative to each other.

In this technical solution, the tool anode has a helical structure.

In this technical solution, the workpiece to be repaired is a hollow rotary body.

The method for repairing the inner wall of the material through the localized electrodeposition by using the hybrid laser-electrochemical technology specifically includes the following steps:

step 1: drawing a motion path model according to graphics of a region to be repaired, and optimizing and importing the model into a computer;

step 2: pretreating the inner and outer surfaces of the workpiece to be repaired;

step 3: connecting the tool anode to a positive electrode of a direct-current pulse power supply and connecting the workpiece to be repaired to a negative electrode of the direct-current pulse power supply;

step 4: immersing the inner surface of the workpiece to be repaired and the tool anode in a deposition solution, turning on the direct-current pulse power supply to form an electrochemical circuit between the workpiece to be repaired and the tool anode, and turning on a peristaltic pump to ensure a uniform concentration of the deposition solution during the electrochemical reaction;

step 5: turning on a pulsed laser, so that the laser beam emitted by the laser is focused and irradiated on the outer surface of the workpiece and heat generated by the laser is transferred via thermal conduction to the region to be repaired on the inner surface of the workpiece to be repaired, and localized electrodeposition occurred in the corresponding region on the inner wall of the workpiece by a regional thermal effect of the laser; and step 6: controlling, by a motion controller, rotation of a tool anode work arm and coordinated motion of an x-y-z three-axis motion platform to perform three-dimensional rapid machining on the workpiece to be repaired according to a set motion path.

In this technical solution, the device includes a laser irradiation system, an electrodeposition machining system, a motion control system, and a circulation system of the electrodeposition solution, where the laser irradiation system includes the pulsed laser, a reflector, and a focusing lens; the laser beam emitted by the laser is reflected by the reflector and then focused by the focusing lens onto the surface of the workpiece to be repaired; the electrodeposition machining system includes the direct-current pulse power supply, a working tank, the workpiece to be repaired, and the tool anode; the workpiece to be repaired is connected to the negative electrode of the direct-current pulse power supply and is clamped by a workpiece work arm to be placed above the working tank; the tool anode is connected to the positive electrode of the direct-current pulse power supply and is clamped by the tool anode work arm to be placed in the workpiece to be repaired, where the tool anode is spaced from the workpiece to be repaired; the motion control system includes the computer and the motion controller; the computer controls the pulsed laser, the peristaltic pump, and the direct-current pulse power supply; the motion controller controls the x-y-z three-axis motion platform, the workpiece work arm, and the tool anode work arm; the circulation system of the electrodeposition solution includes the peristaltic pump and a tube; the peristaltic pump provides a sufficient inlet flow of the electrodeposition solution to make the electrodeposition solution fully contact the workpiece to be repaired and the tool anode to form a circuit.

A method for induced localized electrodeposition on a back side of a thin-walled workpiece through laser irradiation is used to perform localized electrodeposition on a back side of a workpiece to be repaired through a combination of laser and an electrochemical reaction, where only the back side of the workpiece to be repaired is immersed in the electrodeposition solution, a second tool anode is placed in the electrodeposition solution and does not contact the workpiece to be repaired, and the laser beam is focused on a front side of the workpiece to be repaired to realize localized electrodeposition on the back side.

In this technical solution, the workpiece to be repaired is a metal thin-walled flat-plate workpiece with good thermal conductivity and has a thickness of 0 to 3 mm, where laser single-pulse energy is 0.1 μJ to 30 μJ, a scanning speed is 10 mm/s to 2000 mm/s, a laser scanning frequency is 500 kHz to 4000 kHz, a laser scanning pitch is 10 μm to 100 μm, and a laser scanning time is 5 s to 300 s; a voltage is 1 V to 5 V, a current pulse frequency is 1 kHz to 1000 kHz, and a current density is 0.1 $A/m^2$ to 5 $A/m^2$.

In this technical solution, when an original coating on the back side of the workpiece to be repaired is damaged, localized repairing is induced by the laser on the damaged coating.

In this technical solution, if the front side of the workpiece to be repaired is also immersed in the electrodeposition solution, the laser beam is focused and irradiated on the front side of the workpiece to be repaired to realize synchronous deposition on the front side and the back side of the workpiece to be repaired.

In this technical solution, the workpiece to be repaired is a metal thin-walled box-shaped workpiece.

Beneficial Effects:

1. To solve the problem that the localized coating on the back side of a thin-walled part such as a plate, tube, or box is difficult to machine and the coating is difficult to repair due to stripping and failure, localized electrodeposition on the back side of the workpiece to be repaired is realized through coordination between the thermal effect of the laser and the electrochemical deposition based on the characteristic of high thermal conductivity of the workpiece to be repaired. The operating process is simple. The problems of high difficulty in preparation, complex positioning, low dimensional precision, and the like of the localized coating on the back side of the thin-walled part can be solved.
2. In the machining process, the pulsed laser is irradiated on the outer surface of the workpiece to be repaired. Based on the advantage that the workpiece to be repaired has high thermal conductivity, the surface of the workpiece is scanned by the laser and the generated heat is rapidly transferred to the inner wall of the material to realize quick repairing through localized electrodeposition of parts such as tubes that have inner walls difficult to machine. The parameters such as the machining current, the laser scanning speed, and the laser single-pulse energy are controlled to realize precise control over the electrodeposition rate, width, and thickness of the inner wall of the workpiece to be repaired.
3. The laser beam is focused on the outer surface of the workpiece to be repaired to realize localized repairing on the back side, which avoids influences on the machining due to the blocking by the tool anode and the direct laser ablation of the coating, realizes localized electrodeposition on inner surfaces of workpieces such as tubes and shafts that have inner walls difficult to machine, and greatly saves the plating solution.

4. In the electrodeposition process, the laser parameters and the electrical parameters are adjusted to control the thickness, precision, and deposition efficiency of the coating, thereby improving the flexibility of production. The shape and structure of the coating are determined by the geometric shape, scanning path, and motions of the laser beam and a micro-tool anode is not needed.
5. Since the tool anode with a rotating helical surface structure is arranged in the workpiece to be repaired, a uniform electric field is provided for the electrodeposition reaction. When the tool anode rotates at a high speed, circulation of the electrodeposition solution and quick replenishment of metal ions are realized, hydrogen bubbles generated by the electrodeposition reaction are discharged in time, negative thermal impacts outside the laser irradiated region are significantly eliminated, the concentration and localization of the thermal effect of laser irradiation are optimized, and the precision, quality, and deposition rate of the coating are improved.
6. The spatial and temporal distribution of the laser energy and the electrochemical parameters are adjusted to realize electrodeposition on the inner surface or polishing on the outer surface of the workpiece or both at the same time, and the machining rates of the electrodeposition and the polishing can be separately controlled.
7. The cathode is entirely immersed in the solution, and after the laser is irradiated on the front side, synchronous localized deposition on the front side and back side of the workpiece to be repaired can be realized and the special machining requirements of complex parts can be met.

REFERENCE NUMERALS IN THE DRAWINGS

Figure 1:
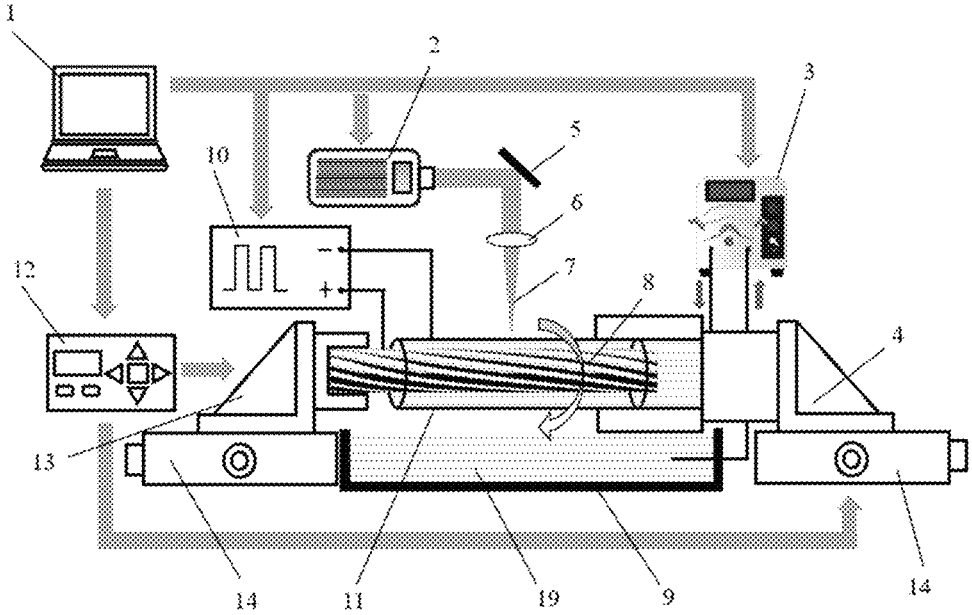
FIG. 1 is a schematic diagram of a machining system for laser-electrochemical localized deposition on an inner wall of a hole through laser irradiation.

1. computer; 2. pulsed laser; 3. peristaltic pump; 4. workpiece work arm; 5. reflector; 6. focusing lens; 7. laser beam; 8. tool anode; 9. working tank; 10. direct-current pulse power supply; 11. thin-walled tubular workpiece; 12. motion controller; 13. tool anode work arm; 14. x-y-z three-axis motion platform; 15. plane localized coating; 16. electric field line; 17. annular localized coating; 18. region to be plated; 19. electrodeposition solution; 20. thin-walled flat-plate workpiece; 21. second tool anode; 22. thin-walled box-shaped workpiece.

DETAILED DESCRIPTION OF THE EMBODIMENTS

Embodiments of the present disclosure are described in detail below and are exemplified in the accompanying drawings, where the same or similar reference signs indicate the same or similar elements or elements with the same or similar functions. The embodiments described below with reference to the accompanying drawings are exemplary and are intended to explain the present disclosure, instead of limiting the present disclosure.

In the description of the present disclosure, it should be understood that terms such as "central", "longitudinal", "transverse", "length", "width", "thickness", "upper", "lower", "axial". "radial", "vertical", "horizontal", "inner", and "outer" indicate directional or positional relationships based on the accompanying drawings. They are merely used for the convenience and simplicity of the description of the present disclosure, instead of indicating or implying that the demonstrated device or element is located in a specific direction or is constructed and operated in a specific direction. Therefore, they cannot be construed as limitations to the present disclosure. In the present disclosure, unless otherwise expressly specified and defined, terms such as "mounted", "interconnected", "connected", and "fixed" should be understood in a broad sense. For example, they may be fixed connections, detachable connections, or integral connections; may be mechanical connections or electrical connections; may be direct connections or indirect connections through an intermediate medium; and may be internal communications between two elements. The specific meanings of the above terms in the present disclosure can be understood by persons of ordinary skill in the art according to specific situations.

A method for repairing an inner wall of a material through localized electrodeposition by using a hybrid laser-electrochemical technology is provided. A laser beam 7 emitted by a laser is focused and irradiated on a surface of a workpiece to be repaired, heat generated by the laser is transferred via thermal conduction to an inner surface of the workpiece to be repaired, and localized electrodeposition in a corresponding region on the back side of the workpiece to be repaired is induced by the regional thermal effect of the laser. Positive and negative electrodes of a direct-current pulse power supply 10 are connected to a tool anode 8 and the workpiece to be repaired, respectively. The tool anode 8 is arranged in the center of the workpiece to be repaired and is spaced from the workpiece to be repaired. The workpiece to be repaired is a conductor with good thermal conductivity, for example, a metallic material. The spatial and temporal distribution of laser energy and electrochemical parameters are adjusted to implement electrodeposition on the inner surface of the workpiece to be repaired, and the electrodeposition rate is controllable. The tool anode 8 with a helical structure is clamped by a tool anode work arm 13 and coaxially arranged with the hollow workpiece to be repaired. A motion control system is used to adjust the rotation speed and control the flow of an electrodeposition solution 19. The tool anode 8 with the helical structure enables circulation of the electrodeposition solution 19 and quick replenishment of metal ions, hydrogen bubbles generated by the electrodeposition reaction are discharged in time, negative thermal impacts outside the laser irradiated region are significantly eliminated, the concentration and localization of the thermal effect of laser irradiation are optimized, and the precision and deposition rate of the coating are improved. The laser beam is focused on the outer surface of the workpiece to realize localized repairing of the inner wall, which avoids influences on the machining due to the blocking by the tool anode 8 and the direct laser ablation of the coating, realizes localized electrodeposition on inner surfaces of workpieces such as tubes and shafts that have inner walls difficult to machine, and greatly saves the plating solution.

The Specific Steps are as Follows:

A motion path model is drawn according to graphics of a region to be repaired. The model is optimized and then imported into a computer 1.

The inner and outer surfaces of the workpiece to be repaired are pretreated.

The workpiece to be repaired is clamped by a workpiece work arm 4 and then fixed above a working tank 9. The tool anode 8 is connected to the positive electrode of the direct-current pulse power supply 10 and is clamped by the tool anode work arm 13 to be placed in the center of the workpiece to be repaired. The tool anode 8 is coaxially arranged with the workpiece to be repaired and is spaced from the workpiece to be repaired. The workpiece to be repaired is connected to the negative electrode of the direct-current pulse power supply 10.

The deposition solution 19 is injected into the working tank 9. A liquid inlet and a liquid outlet of a peristaltic pump 3 are connected to the working tank 9 and an end of the workpiece to be repaired, respectively. The peristaltic pump 3 is turned on and the flow is adjusted to make the inner surface of the workpiece to be repaired and the tool anode 8 immersed in the deposition solution 19. After being powered on, the workpiece to be repaired and the tool anode 8 form an electrochemical circuit. A uniform concentration of the deposition solution 19 is ensured during the electrochemical reaction.

The workpiece work arm 4 and the tool anode work arm 13 are mounted on an x-y-z three-axis motion platform 14 and their heights and positions are adjusted, so that the laser beam 7 is focused on the outer surface of the workpiece to be repaired and corresponds to the region to be repaired on the inner surface of the workpiece to be repaired.

The direct-current pulse power supply 10 and the pulsed laser 2 are turned on to achieve the effect of laser-induced electrochemical deposition.

A motion controller 12 controls rotation of the workpiece work arm 4 and coordinated motion of the x-y-z three-axis motion platform 14 to perform three-dimensional rapid machining on the workpiece according to a set motion path.

A device for repairing an inner wall of a material through localized electrodeposition by using a hybrid laser-electrochemical technology is provided, which includes a laser irradiation system, an electrodeposition machining system, a motion control system, and a circulation system of the electrodeposition solution 19. The laser irradiation system includes the pulsed laser 2, a reflector 5, and a focusing lens 6. The laser beam 7 emitted by the laser 2 is reflected at 45° by the reflector 5 and is redirected to be focused by the focusing lens 6 onto the surface of the workpiece to be repaired. The electrodeposition machining system includes the direct-current pulse power supply 10, the working tank 9, the workpiece to be repaired, and the tool anode 8. The workpiece to be repaired is connected to the negative electrode of the direct-current pulse power supply 10 and is clamped by the workpiece work arm 4 to be placed above the working tank 9. The tool anode 8 is connected to the positive electrode of the direct-current pulse power supply 10 and is clamped by the tool anode work arm 13 to be placed directly below the workpiece to be repaired, where the tool anode 8 is spaced from the workpiece to be repaired. The motion control system includes the computer and the motion controller. The computer controls the pulsed laser 2, the peristaltic pump 3, and the direct-current pulse power supply 10. The motion controller controls the x-y-z three-axis motion platform 14, the workpiece work arm 4, and the tool anode work arm 13. The circulation system of the electrodeposition solution 19 includes the tool anode 8, the peristaltic pump 3, and a pump tube. The peristaltic pump 3 provides a sufficient inlet flow of the electrodeposition solution 19 to make the electrodeposition solution 19 fully contact the cathode and the anode to form a circuit. The workpiece is clamped by the work arm 4 to perform axial rotation, so that rotary machining on the rotatable workpiece to be repaired can be implemented.

Referring to FIG. 1, the computer 1 is connected to the direct-current pulse power supply 10, the pulsed laser 2, the peristaltic pump 3, and the motion controller 12. The computer 1 controls and adjusts laser parameters of the pulsed laser 2, electrical parameters of the direct-current pulse power supply 10, and flow parameters of the peristaltic pump 3. The motion controller 12 controls the motion of the x-y-z three-axis motion platform 14 and the rotation of the workpiece work arm 4 and the tool anode work arm 13 that clamp the workpiece to be repaired and the tool anode 8, respectively.

The workpiece to be repaired is placed above the working tank 9. The tool anode 8 is located in the center of the workpiece to be repaired and is spaced from the inner wall of the workpiece to be repaired. The flow parameters of the peristaltic pump 3 are adjusted to make the space filled with the electrodeposition solution 19. The positive electrode of the direct-current pulse power supply 10 is connected to the tool anode 8 and the negative electrode of the direct-current pulse power supply 10 is connected to the workpiece to be repaired to form an electrochemical circuit. The laser beam 7 emitted by the pulsed laser 2 is redirected by the reflector 5 and then focused by the focusing lens 6 onto the surface of the workpiece to be repaired. The thermal effect of the laser on the surface is transferred to the inner wall of the workpiece to be repaired to induce electrodeposition on the inner wall of the workpiece to be repaired. The motion controller 12 controls the rotation of the workpiece work arm 4 and the laser scanning path adjusted by the computer to implement deposition in the shape of the region to be repaired. The liquid inlet and the liquid outlet of the peristaltic pump 3 are connected to the working tank 9 and one end of the workpiece to be repaired, respectively. The electrodeposition solution 19 is stored in the working tank 9. The peristaltic pump 3 provides power to deliver the deposition solution 19 from the working tank 9 into the workpiece to be repaired, and the electrodeposition solution 19 flows back into the working tank 9 via the other end of the workpiece to be repaired to form circulation.

Figure 2:
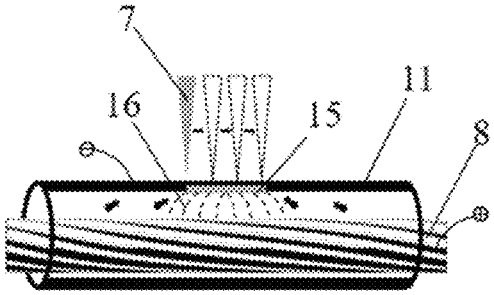
FIG. 2 is a schematic diagram showing the effect of laser-electrochemical localized deposition of a plane coating on the inner wall of the hole.
Figure 3:
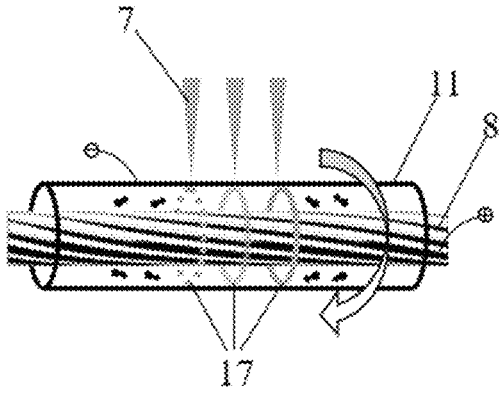
FIG. 3 is a schematic diagram showing the effect of laser-electrochemical localized deposition of an annular coating on the inner wall of the hole.
Figure 4:
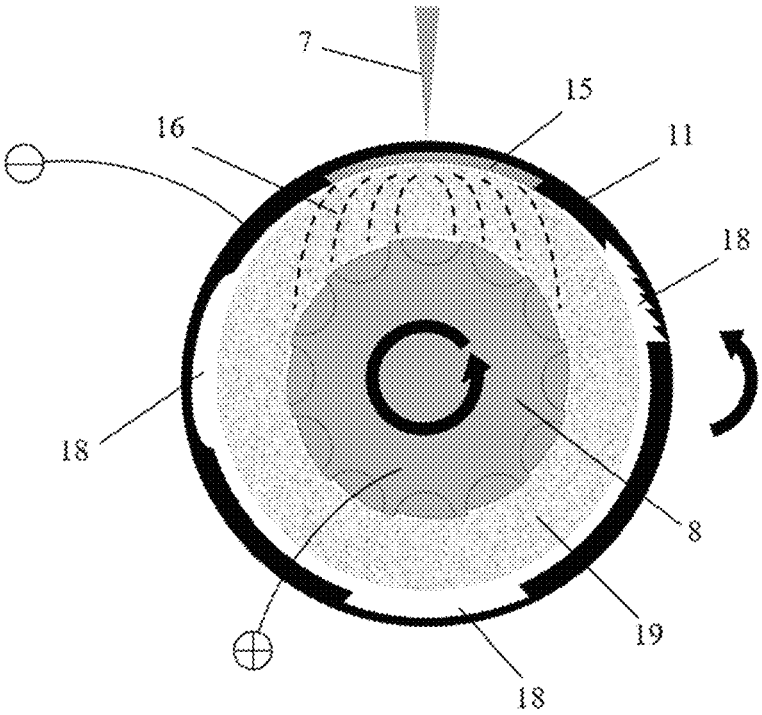
FIG. 4 is a process sectional view of the localized coating in FIG. 2 and FIG. 3.

Referring to FIG. 2 and FIG. 3, the thermal effect generated after the laser beam is focused on the surface of the workpiece to be repaired is transferred to the inner wall of the workpiece to be repaired to cause a regional electric field concentration effect, thereby restricting electrodeposition to the back side of the laser irradiated region. When the focused laser beam 7 cyclically scans back and forth along the preset path, the repairing of a plane coating is realized on the inner wall of the workpiece to be repaired. The laser parameters, the electrical parameters, and the rotation speed of the tool anode 8 are adjusted and controlled for control over the thickness, precision, and deposition rate of the coating. After the workpiece to be repaired is adjusted and controlled to rotate by the motion controller 12, the computer 1 adjusts different laser parameters and light output frequencies to prepare annular repaired coatings of different shapes and sizes. FIG. 4 is a process sectional view of the coating after localized repairing. Localized electroplating of the region to be repaired 18 is implemented via mutual cooperation of the rotation of the workpiece to be repaired and the scanning path of the laser beam 7.

The Specific Implementation of the Present Disclosure is as Follows:

The shape of the region to be repaired is analyzed to design the laser scanning path and the dynamic adjustment and control scheme of the x-y-z three-axis motion platform 14, to ensure that the repaired coating has the same flatness as the original coating and the dimensional precision of the coating meets the requirements.

The workpiece to be repaired needs to be made of a material with good thermal conductivity and has a thickness of 0 to 3 mm. The space between the inner wall of the workpiece and the tool anode 8 is kept in a range of 3 mm to 5 mm. The inner and outer surfaces of the workpiece to be repaired are pretreated. The workpiece to be repaired is connected to the negative electrode of the direct-current pulse power supply 10, and the tool anode 8 is connected to the positive electrode of the direct-current pulse power supply 10.

The material of the tool anode 8 is reasonably selected according to requirements of the coating and the deposition solution, and the shape of the tool anode 8 is customized according to the shape of the workpiece. The end of the tool anode 8 clamped by the tool anode work arm 13 needs to be insulated to ensure that the electric field only exists uniformly in the space between the tool anode 8 and the workpiece to be repaired.

The electrodeposition solution 19 is added into the working tank 9. The tool anode 8 with the helical surface structure is clamped by the tool anode work arm 13 and rotates to enable rapid flowing of the electrodeposition solution. Therefore, the negative thermal impacts outside the laser irradiated region are significantly eliminated, the concentration of the thermal effect of laser irradiation is optimized, the localization of the coating is improved, and stray deposition is avoided.

The peristaltic pump 3 is turned on to enable circulation of the deposition solution, so that the metal ions are quickly replenished, the influence of concentration polarization is suppressed, the hydrogen bubbles generated by the electrodeposition reaction are discharged in time, and the surface quality and production efficiency of the coating are improved.

The laser 2, the direct-current pulse power supply 10, and the motion controller 12 are turned on and the x-y-z three-axis motion platform 14 is dynamically adjusted according to the shape and size of the region to be repaired, so that the size of the laser spot and the defocusing amount of the laser are adjusted to achieve efficient deposition in the region to be repaired.

Embodiment 1

A round tube made of a nickel sheet is taken as an example below to illustrate the implementation of a method for induced localized electrodeposition on a back side of a thin-walled workpiece through laser irradiation according to the present disclosure. The method includes the following steps:

(1) The cathode used in this embodiment is a copper-based nickel-plated round tube with an outer diameter of 130 mm, a wall thickness of 0.1 mm, and a length of 30 mm. The tool anode is an insoluble anode made of a ruthenium-iridium coated titanium plate (15×20×2 mm) and is arranged inside the cathode. The cathode and the anode are spaced apart by 10 mm. The tube is filled with the electrodeposition solution. The current density is 2 A/m$^2$, a unidirectional pulse power supply is adopted, the pulse frequency is 1 kHz, and the duty cycle is 50%, the laser single-pulse energy is 6 μJ, the scanning speed is 2000 mm/s, the laser pulse frequency is 4000 kHz, the scanning pitch is 0.02 mm, and the laser scanning time is 60 s, the ambient temperature is 25° C., and the deposited pattern is a linear coating.

(2) Referring to FIGS. 5A-5B and FIGS. 6A-6B, the tube is cut open and the morphology of the coating on its inner surface is observed. The coating is 1 mm wide and about 3 μm thick. It can be seen that the coating has a clear shape, high brightness and flatness, and good appearance. Localized electrodeposition on the inner surface of the tube can be realized.

According to the method for induced localized electrodeposition on the back side of the thin-walled workpiece through laser irradiation, the laser beam 7 emitted by the laser is focused and irradiated on a front side of a thin-walled tubular workpiece 11, heat generated by the laser is rapidly transferred via thermal conduction to a back side of the workpiece to induce electrodeposition, and the temperature rise in other regions on the back side is insufficient to cause electrochemical deposition; therefore, localized electrodeposition on the back side of the thin-walled tubular workpiece 11 is realized. The positive and negative electrodes of the direct-current pulse power supply 10 are connected to the tool anode 8 and the thin-walled tubular workpiece 11, respectively. The thin-walled tubular workpiece 11 is a metal thin-walled workpiece with good thermal conductivity. The laser beam is focused on the front side of the workpiece to realize localized electrodeposition on the back side of the workpiece. This method is applicable to localized deposition on the back sides of thin-walled parts such as plates, tubes, and boxes.

Figure 5A:
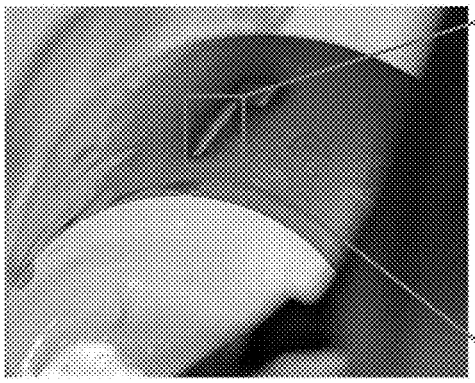
FIGS. 5A-5B show optical microscope images of a linear coating on an inner surface of a tube according to Embodiment 1 of the present disclosure, where the region marked by C is the coating and the region marked by M is the inner surface of the tube.
Figure 5B:
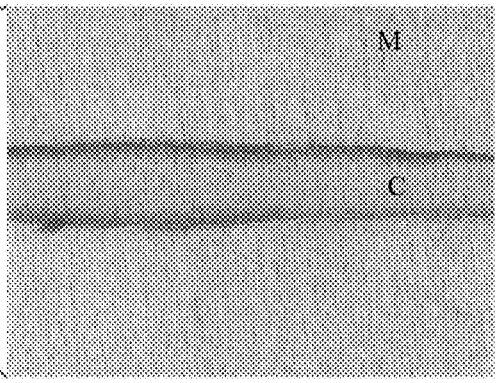
Figure 7:
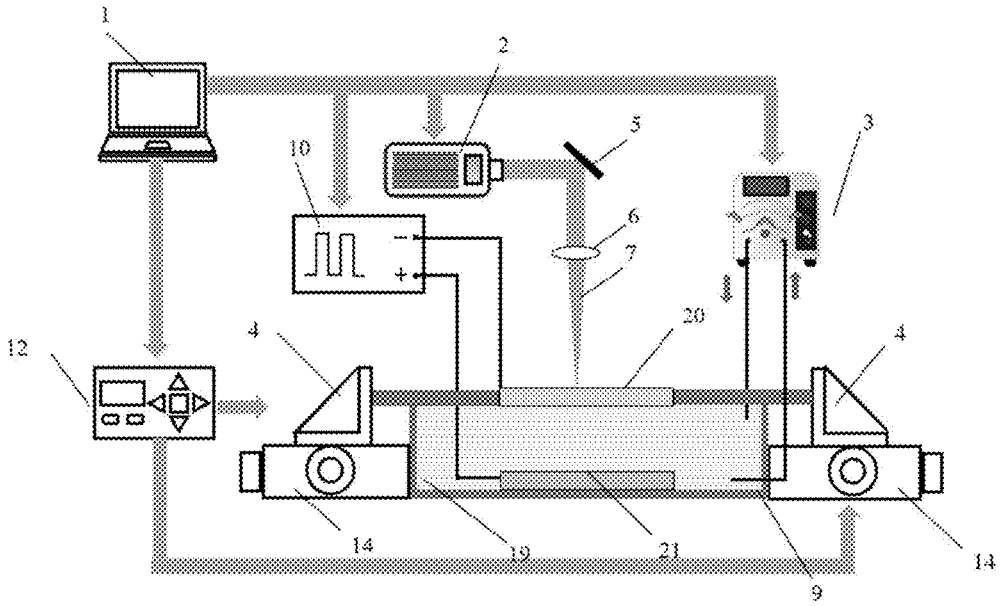
FIG. 7 is a schematic diagram of a machining system for induced localized electrodeposition on a back side of a thin-walled workpiece through laser irradiation.
Figure 8:
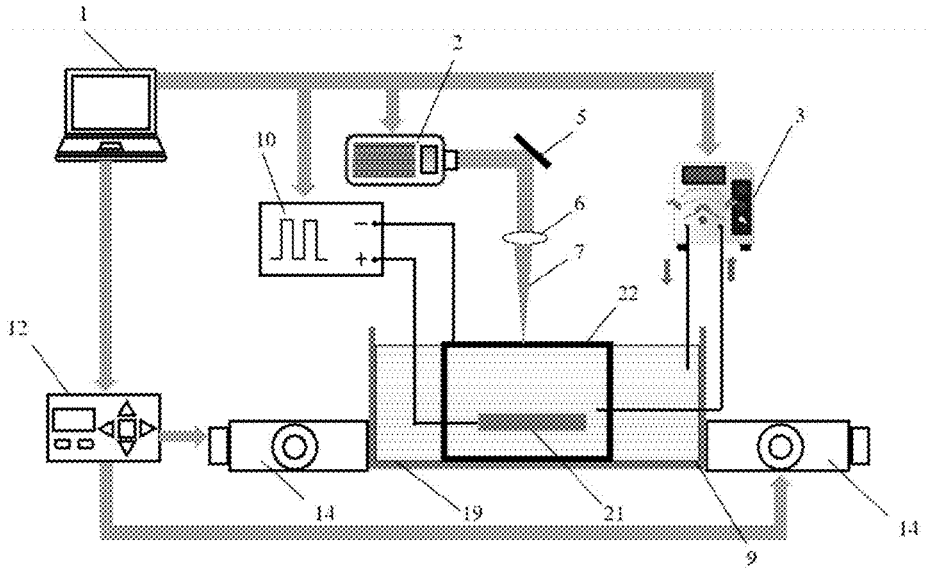
FIG. 8 is a schematic diagram of a machining system for laser-electrochemical localized deposition on an inner wall of a box-shaped workpiece.
Figure 9:
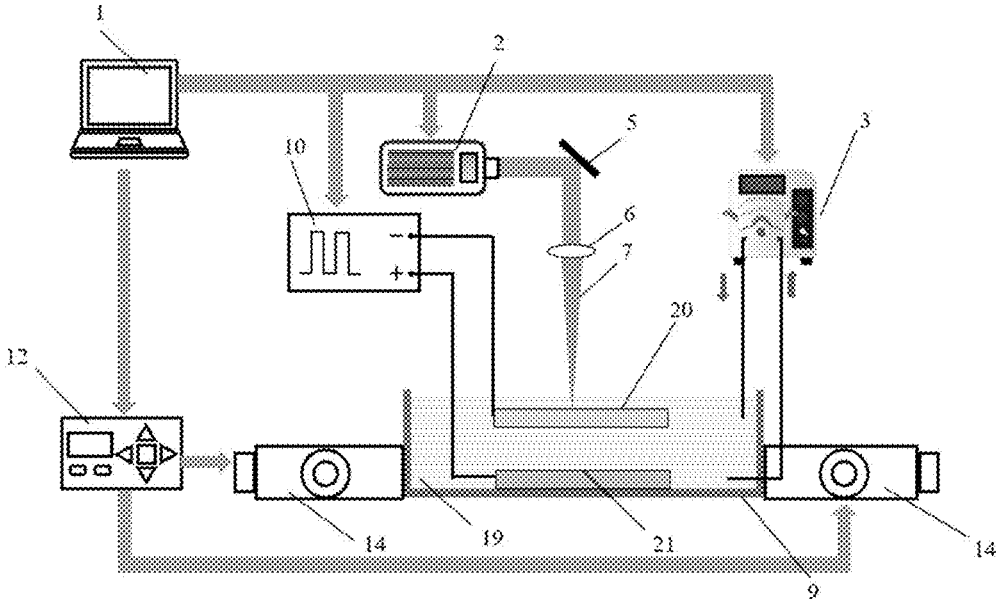
FIG. 9 is a schematic diagram of a machining system for localized electrodeposition on front and back sides of a thin-walled flat-plate workpiece through laser irradiation.

Referring to FIG. 7 to FIG. 9, the thermal effect generated after the laser beam is focused on the outer surface of the thin-walled tubular workpiece 11 is transferred to the inner wall of the thin-walled tubular workpiece 11 to cause a regional electric field concentration effect, thereby restricting electrodeposition to the back side of the laser irradiated region. When the focused laser beam 7 cyclically scans back and forth along the preset path, localized deposition of a plane coating is realized on the inner wall of the thin-walled tubular workpiece 11. The laser parameters, the electrical parameters, and the rotation speed of a helical tool anode 21 are adjusted and controlled for control over the thickness, precision, and deposition rate of the coating. After the thin-walled tubular workpiece 11 is adjusted and controlled to rotate by the motion controller 12, the computer 1 adjusts different laser parameters and light output frequencies to prepare annular localized coatings of different shapes and sizes. FIGS. 5A-5B are a process sectional view of the localized electrodeposited coating. Localized electroplating in the region to be deposited 18 is implemented via mutual cooperation of the rotation of the thin-walled tubular workpiece 11 and the scanning path of the laser beam 7.

A thin-walled box-shaped workpiece 22 is placed in the working tank 9. The tool anode 8 is located in the thin-walled box-shaped workpiece 22 and does not contact the thin-walled box-shaped workpiece 22. The flow parameters of the peristaltic pump 3 are adjusted to make the thin-walled box-shaped workpiece 22 filled with the electrodeposition solution 19. The positive electrode of the direct-current pulse power supply 10 is connected to the tool anode 8 and the negative electrode of the direct-current pulse power supply 10 is connected to the thin-walled box-shaped workpiece 22 to form an electrochemical circuit. The laser beam 7 emitted by the pulsed laser 2 is redirected by the reflector 5 and then focused by the focusing lens 6 onto the surface of the thin-walled box-shaped workpiece 22. The thermal effect of the laser on the surface is transferred to the inner wall of the thin-walled box-shaped workpiece 22 to induced electrodeposition on the inner wall of the thin-walled box-shaped workpiece 22. The motion controller 12 controls the position of the thin-walled box-shaped workpiece 22 and the laser scanning path adjusted by the computer to implement deposition in the shape of the target region. The liquid inlet and the liquid outlet of the peristaltic pump 3 are connected to the bottom of the thin-walled box-shaped workpiece 22 and the top of the working tank 9, respectively. The electrodeposition solution 19 is stored in the working tank 9. The peristaltic pump 3 provides power to deliver the deposition solution 19 from the bottom of the thin-walled box-shaped workpiece 22 to the top of the working tank 9.

Embodiment 2

A nickel sheet is taken as an example below, that is, a thin-walled flat-plate workpiece 20 made of a nickel sheet is used to illustrate the implementation of the method for induced localized electrodeposition on the back side of the thin-walled workpiece through laser irradiation according to the present disclosure. The method includes the following steps:

(1) The cathode and anode parameters, laser parameters, electrical parameters, and solution proportioning are determined. The cathode used in this embodiment is a copper-based nickel-plated plate (30×20×0.1 mm), the tool anode is an insoluble anode made of a ruthenium-iridium coated titanium mesh (15×20×2 mm), and the cathode and the anode are spaced apart by 3 mm. The current density is 2 A/m$^2$, a unidirectional pulse power supply is adopted, the pulse frequency is 1 kHz, and the duty cycle is 50%, the laser single-pulse energy is 6 μJ, the scanning speed is 2000 mm/s, the laser pulse frequency is 2500 kHz, and the scanning pitch is 0.02 mm. The adopted electrodeposition system is an acid cyanide gold plating system, the solution is mainly composed of 6 g/L of potassium auric cyanide, 70 g/L of citric acid, 90 g/L of potassium citrate, and 3 g/L of cobalt sulfate heptahydrate, the pH value of the solution is 3.9 to 4.0, and the ambient temperature is 25° C.

Figure 10:
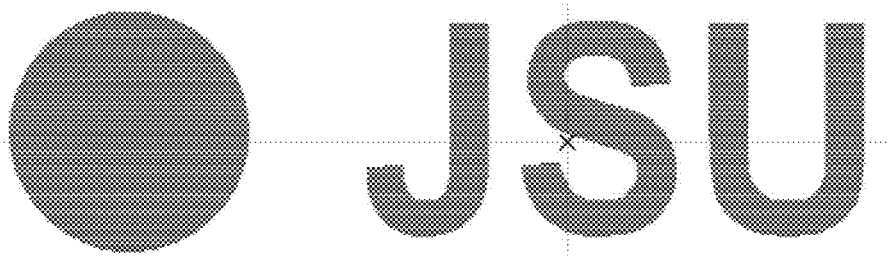
FIG. 10 shows a laser scanning path according to Embodiment 2 of the present disclosure.
Figure 11A:
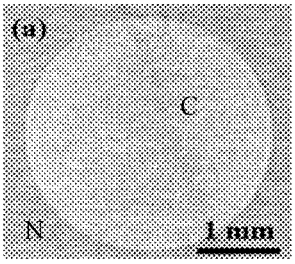
FIGS. 11A-11D show localized coatings prepared on a front side and a back side of a thin-walled workpiece according to Embodiment 2 of the present disclosure, where the region marked by C is the coating, the region marked by M is the back side of the thin-walled workpiece, and the region marked by N is the front side of the thin-walled workpiece.
Figure 11B:
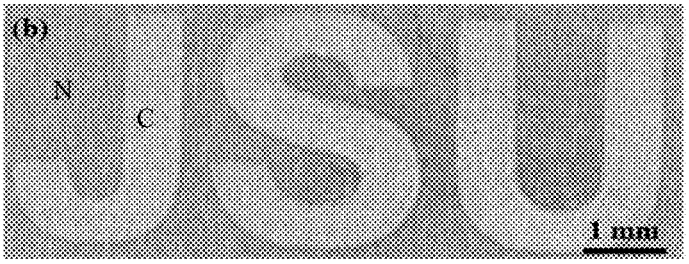
Figure 11C:
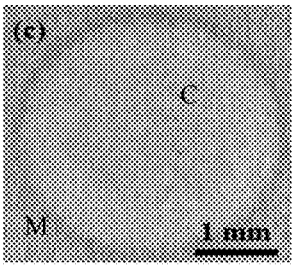
Figure 11D:
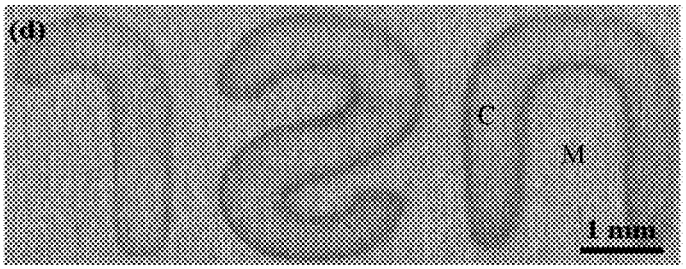
Figure 12:
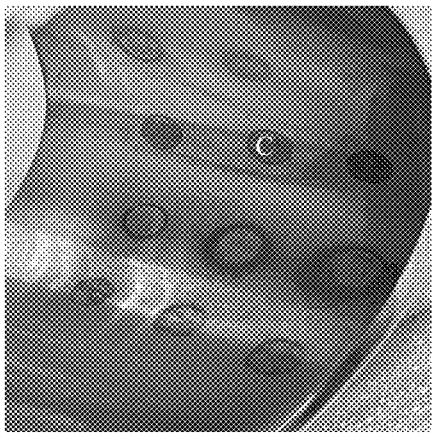
FIG. 12 shows an optical microscope image of a part of localized electroplating results obtained at different scanning speeds on an inner surface of a thin-walled tubular workpiece according to Embodiment 3 of the present disclosure, where the region marked by C is the coating and the region marked by M is the inner surface of the tube.

(2) The laser scanning path shown in FIG. 10 is drawn by the computer 1. After the laser beam 7 is focused on the front side of the thin-walled flat-plate workpiece 20 and scans for 30 s according to the scanning motion path in FIG. 10, a localized coating shown in FIGS. 11A-11D are obtained. It can be clearly seen from the figure that a localized coating completely consistent with the scanning path is obtained in the laser irradiated region on the front side of the workpiece. Due to the law of thermal conduction, the backside deposited region is slightly different from the scanning path, but the shape of the deposited region is still clear and complete, and the interface between the coating and the substrate is clear. This embodiment shows that the present disclosure can realize high-precision backside and double-sided localized deposition, and the process effects and expected results mentioned in the specification can be completely realized.

(3) In order to verify whether the service performance of the coating prepared in this embodiment meets the requirements, the corrosion resistance, bonding force, soldering performance, and microhardness of the coating are tested and compared with the performance of gold-plated samples provided by professional electroplating companies, and the test results show that the prepared coating completely meets the actual production requirements.

Corrosion resistance test: The coating is immersed in 2 mol/L hydrochloric acid for 24 h, and the morphology changes of the coating are observed with an optical microscope and an electron microscope. If there is no obvious change in the coating and no evidence of corrosion such as cracking and stripping is found on the surface, it indicates that the gold-plated layer has good corrosion resistance. In addition, Tafel test is carried out on the coating in a 3.5% NaCl solution, and the test results show that the corrosion current density and the corrosion potential are equal to or superior to those of the coating prepared by a conventional gold plating process.

Bonding force test: A bending test and a thermal shock test are performed to check the bonding force of the gold-plated layer. In the bending test, the sample is repeatedly bent by 180° until it breaks and it is observed whether the coating falls off at the break. In the thermal shock test, the plated workpiece is placed in a resistance furnace at 280° C. for 30 min and then immediately quenched in water at the room temperature to observe the morphology of the coating. If stripping of the coating at the break is not found in the bending test and phenomena such as peeling, bulging, and stripping of the coating are not found in the thermal shock test, it indicates that the gold-plated layer in this application has good bonding force and can overcome extreme service conditions.

Soldering performance test: A constant-temperature electric soldering iron is used to perform a spot soldering test on the surface of the substrate and the gold-plated layer to observe and compare their wettability. The gold-plated layer prepared in this application has good surface wettability and the solder joints can be evenly spread, which ensures the soldering performance of the parts and guarantees the electronic stability of the electronic components.

Microhardness test: The microhardness of the gold-plated layer prepared with the optimized parameters is measured by a microhardness tester at a load of 10 g for 20 s. Five gold-plated samples are prepared with the optimized parameters, and five points are selected from each sample for microhardness testing and an average value is recorded. It can be seen from the microhardness test values that the average microhardness of the coating is 130 HV to 195 HV, which meets the microhardness requirements of the gold-plated layer and is applicable to the service conditions of repeated plugging and unplugging of the electronic components.

Embodiment 3

Figure 6A:
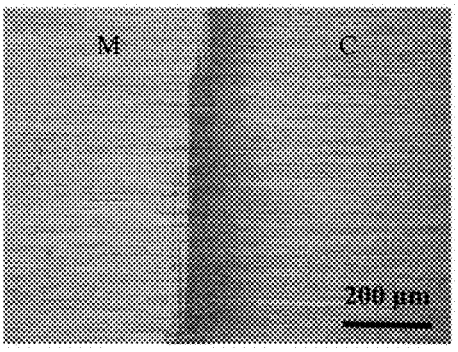
FIGS. 6A-6B show three-dimensional morphology views of an interface between the linear coating on the inner surface of the tube and a substrate according to Embodiment 1 of the present disclosure, where the region marked by C is the coating and the region marked by M is the inner surface of the tube.
Figure 6B:
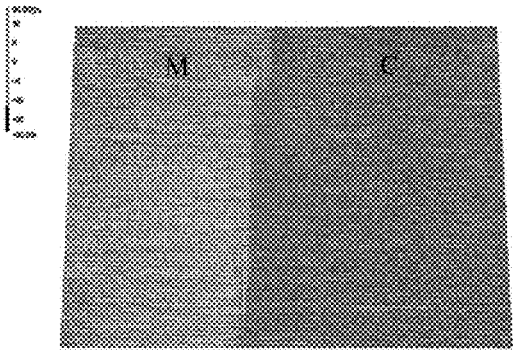

A round tube made of a nickel sheet is taken as an example below to illustrate the implementation of the method for induced localized electrodeposition on the back side of the thin-walled workpiece through laser irradiation according to the present disclosure. The method includes the following steps:

(1) The cathode used in this embodiment is a copper-based nickel-plated round tube as shown in FIGS. 5A-5B. The cathode has an outer diameter of 130 mm, a wall thickness of 0.1 mm, and a length of 30 mm. The tool anode is an insoluble anode made of a ruthenium-iridium coated titanium plate (15×20×2 mm) and is arranged inside the cathode. The cathode and the anode are spaced apart by 10 mm. The tube is filled with the electrodeposition solution. The current density is 2 $A/m^2$, a unidirectional pulse power supply is adopted, the pulse frequency is 1 kHz, and the duty cycle is 50%, the laser pulse frequency is 4000 kHz, the scanning pitch is 0.02 mm, and the laser single-pulse energy is 3.6 μJ, the ambient temperature is 25° C., and the deposited pattern is a circle with a diameter of 3 mm. FIGS. 6A-6B show comparison between the morphologies of the coatings obtained at different scanning speeds.

Figure 13A:
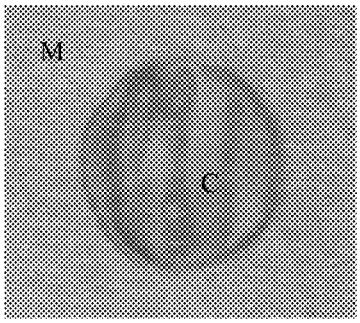
FIGS. 13A-13C show optical microscope images of (a part of) the localized coating obtained by induced deposition on the inner wall surface of the tube in FIG. 12 after the tube is cut open and unfolded, where the region marked by C is the coating and the region marked by M is the inner surface of the tube.
Figure 13B:
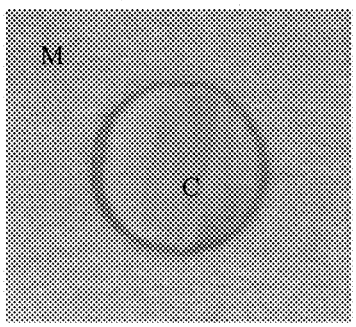
Figure 13C:
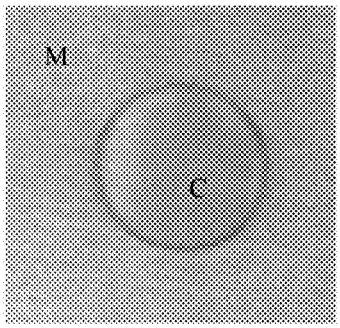

(2) FIGS. 13A-13C are images at the scanning speeds of 10 mm/s, 20 mm/s, and 30 mm/s, respectively. It can be observed that electrodeposition on the inner wall surface of the tube can be induced at different scanning speeds. The coating obtained at the scanning speed of 30 mm/s has a clear shape, high brightness and flatness, and good appearance.

Embodiment 4

A nickel sheet is taken as an example below to illustrate the implementation of the method for induced localized electrodeposition on the back side of the thin-walled workpiece through laser irradiation according to the present disclosure. The method includes the following steps:

(1) The cathode used in this embodiment is a copper-based nickel-plated sheet (30×20×0.1 mm), the tool anode is an insoluble anode made of a ruthenium-iridium coated titanium plate (15×20×2 mm), and the cathode and the anode are spaced apart by 3 mm. The cathode and the anode are placed in parallel and facing each other. A unidirectional pulse power supply is adopted, the pulse frequency is 1 kHz, and the duty cycle is 50%, the laser pulse frequency is 3000 kHz, the ambient temperature is 25° C., and the deposited patterns are a 3×3 mm square and a circle with a diameter of 3 mm. FIGS. 14A-14D, FIGS. 15A-15F, FIGS. 16A-16F, and FIGS. 17A-17F show comparison between the morphologies of the coatings obtained with different laser single-pulse energy, scanning speeds, scanning pitches, and current densities, respectively.

Figure 14A:
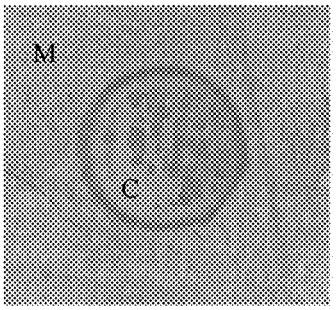
FIGS. 14A-14D show optical microscope images of a part of localized electroplating results obtained with different single-pulse energy on a back side of a thin-walled flat-plate workpiece according to Embodiment 4 of the present disclosure, where the region marked by C is the coating and the region marked by M is the back side of the flat-plate workpiece.
Figure 14B:
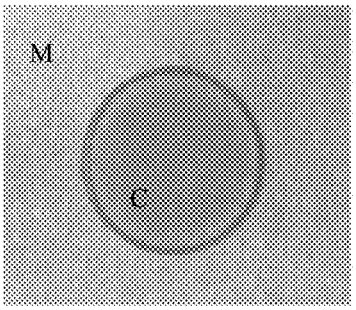
Figure 14C:
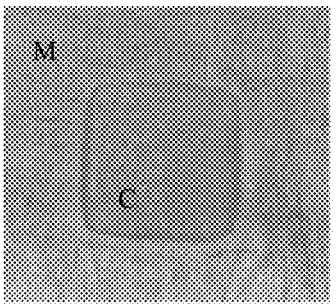
Figure 14D:
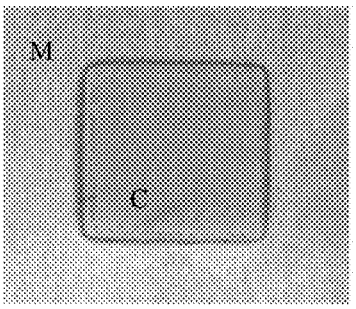

(2) As shown in FIGS. 14A-14D, when the scanning speed is 10 mm/s, the scanning pitch is 0.02 mm, and the current density is 2 $A/m^2$, the laser single-pulse energy for FIG. 14A and FIG. 14C is 2.93 μJ and the laser single-pulse energy for FIG. 14B and FIG. 14D is 4.8 μJ. It can be observed that localized electrodeposition on the back side of the metal thin-walled workpiece can be induced by different single-pulse energy. The coating obtained with the single-pulse energy of 4.8 μJ has a clear shape, high brightness and flatness, and good appearance.

Figure 15A:
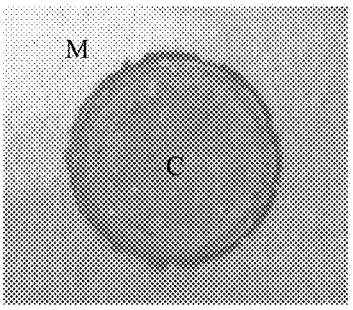
FIGS. 15A-15F show optical microscope images of a part of localized electroplating results obtained at different scanning speeds on the back side of the thin-walled flat-plate workpiece according to Embodiment 4 of the present disclosure, where the region marked by C is the coating and the region marked by M is the back side of the flat-plate workpiece.
Figure 15B:
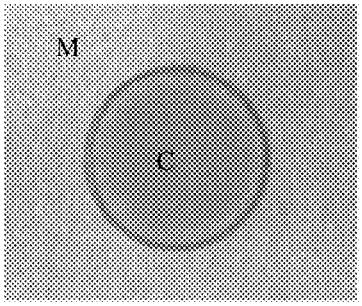
Figure 15C:
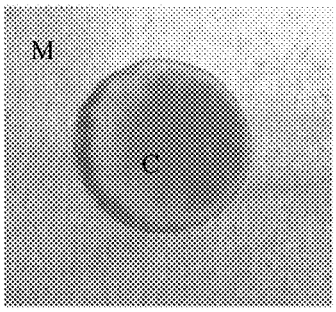
Figure 15D:
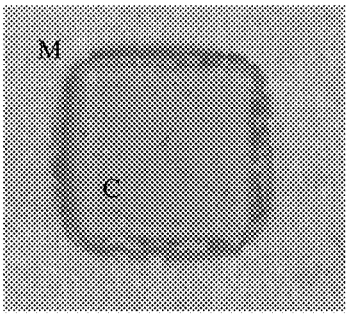
Figure 15E:
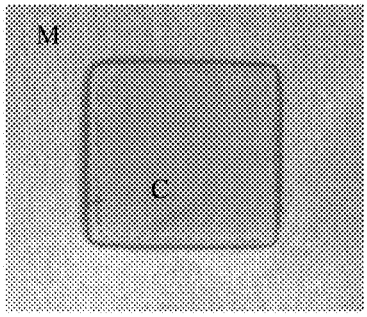
Figure 15F:
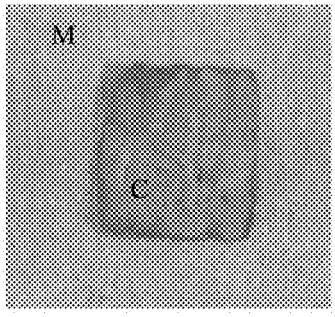

(3) As shown in FIGS. 15A-15F, when the single-pulse energy is 4.8 μJ, the scanning pitch is 0.02 mm, and the current density is 2 A/m$^2$, comparison is made between the coatings obtained at the scanning speeds of 5 mm/s in FIG. 15A and FIG. 15D, 10 mm/s in FIG. 15B and FIG. 15E, and 25 mm/s in FIG. 15C and FIG. 15F. It can be observed that localized electrodeposition on the back side of the metal thin-walled workpiece can be induced by different scanning speeds. The coating obtained at the scanning speed of 10 mm/s has a clear shape, high brightness and flatness, and good appearance.

Figure 16A:
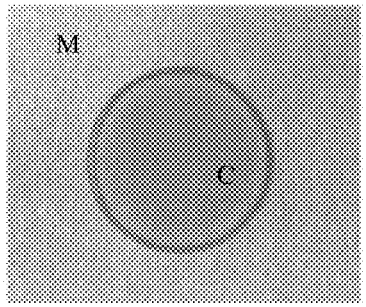
FIGS. 16A-16F show optical microscope images of a part of localized electroplating results obtained with different scanning pitches on the back side of the thin-walled flat-plate workpiece according to Embodiment 4 of the present disclosure, where the region marked by C is the coating and the region marked by M is the back side of the flat-plate workpiece.
Figure 16B:
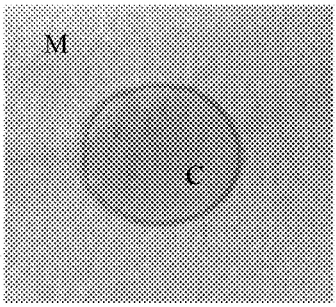
Figure 16C:
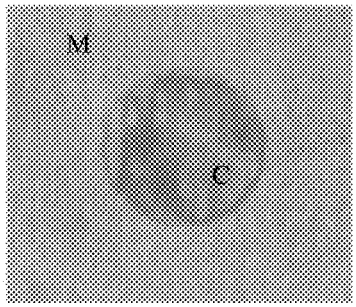
Figure 16D:
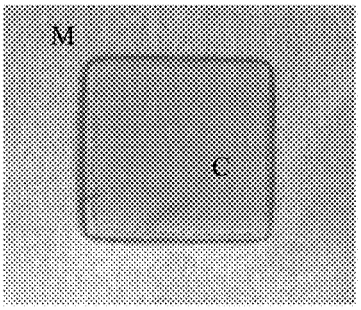
Figure 16E:
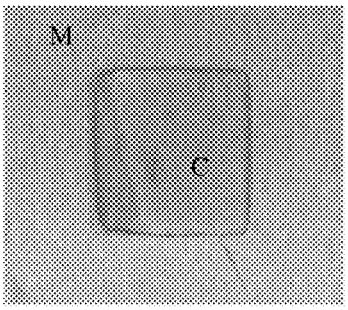
Figure 16F:
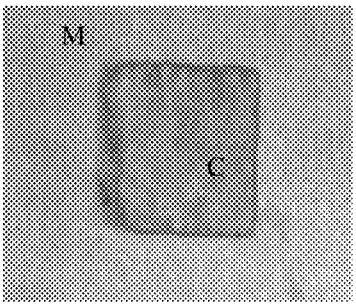

(4) As shown in FIGS. 16A-16F, when the single-pulse energy is 4.8 μJ, the scanning speed is 10 mm/s, and the current density is 2 A/m$^2$, comparison is made between the coatings obtained with the scanning pitches of 0.02 mm in FIG. 16A and FIG. 16D, 0.03 mm in FIG. 16B and FIG. 16E, and 0.05 mm in FIG. 16C and FIG. 16F. It can be observed that localized electroplating on the back side of the metal thin-walled workpiece can be induced by different scanning pitch parameters. The coating obtained with the scanning pitch of 0.02 mm has a clear shape, high brightness and flatness, and good appearance.

Figure 17A:
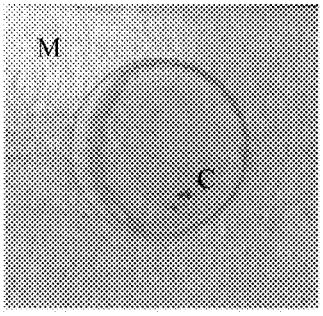
FIGS. 17A-17F show optical microscope images of a part of localized electroplating results obtained with different current densities on the back side of the thin-walled flat-plate workpiece according to Embodiment 4 of the present disclosure, where the region marked by C is the coating and the region marked by M is the back side of the flat-plate workpiece.
Figure 17B:
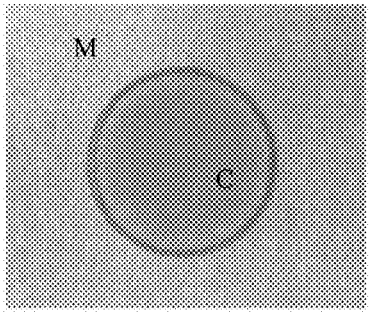
Figure 17C:
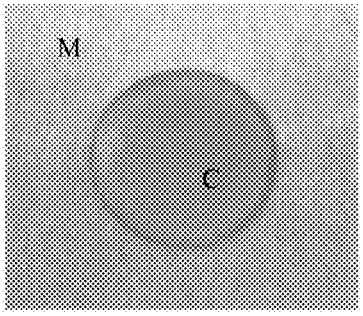
Figure 17D:
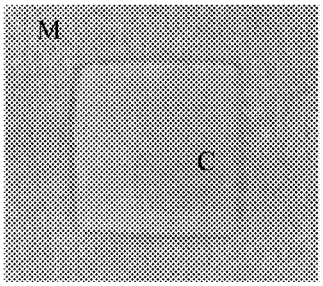
Figure 17E:
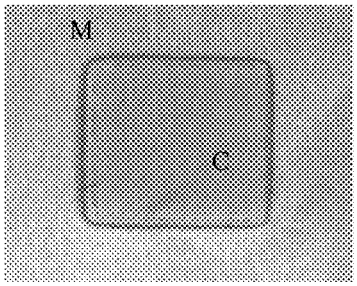
Figure 17F:
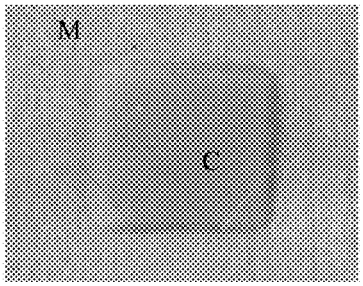

(5) As shown in FIGS. 17A-17F, when the single-pulse energy is 4.8 μJ, the scanning speed is 10 mm/s, and the scanning pitch is 0.02 mm, comparison is made between the coatings obtained with the current densities of 1 A/m$^2$ in FIG. 17A and FIG. 17D, 2 A/m$^2$ in FIG. 17B and FIG. 17E, and 3 A/m$^2$ in FIG. 17C and FIG. 17F. It can be observed that localized electroplating on the back side of the thin-walled workpiece can be induced by different current densities. The coating obtained with the current density of 2 A/m$^2$ has a clear shape, high brightness and flatness, and good appearance.

According to Embodiments 1 to 4, good localized repairing can be achieved with the thickness of the thin-walled tubular workpiece and the sheet in 0 to 3 mm, the laser single-pulse energy of 0.1 μJ to 30 μJ, the scanning speed of 10 mm/s to 2000 mm/s, the laser scanning frequency of 500 kHz to 4000 kHz, the laser scanning pitch of 10 μm to 100 μm, and the laser scanning time of 5 s to 300 s, the voltage of 1 V to 5 V, the current pulse frequency of 1 kHz to 1000 kHz, and the current density of 0.1 A/m$^2$ to 5 A/m$^2$.

In this specification, descriptions with reference to the terms "one embodiment", "some embodiments", "examples", "specific examples", "some examples" and the like denote that the specific features, structures, materials, or characteristics illustrated by the embodiments or examples are incorporated in at least one embodiment or example of the present disclosure. In this specification, the schematic statements of the above terms do not necessarily mean the same embodiments or examples. Moreover, the illustrated specific features, structures, materials, or characteristics can be properly combined in any one or more embodiments or examples.

Although the embodiments of the present disclosure have been shown and described, it can be understood that the above embodiments are exemplary and shall not be construed as limitations to the present disclosure. Changes, modifications, replacements, and variations can be made to these embodiments within the scope of the present disclosure by persons of ordinary skill in the art without departing from the principle and purpose of the present disclosure.

What is claimed is:

1. A method for repairing the inner wall of the material through the localized electrodeposition by using the hybrid laser-electrochemical technology, wherein the method repairs a workpiece using a laser and an electrochemical reaction, a tool anode is arranged in a center of the workpiece, the tool anode is spaced from the workpiece, and a laser beam is focused on an outer surface of the workpiece to locally repair the inner wall, and wherein a spatial and temporal distribution of a laser energy and electrochemical parameters are adjusted to implement an electrodeposition on an inner surface of the workpiece to be repaired, and an electrodeposition rate is controllable, and wherein a laser single-pulse energy is 0.1 μJ to 30 ρJ, a scanning speed is 10 mm/s to 2000 mm/s, a laser scanning frequency is 500 kHz to 4000 kHz, a laser scanning pitch is 10 μm to 100 μm, and a laser scanning time is 5 s to 300 s; a voltage is 1 V to 5 V, a current pulse frequency is 1 kHz to 1000 kHz, and a current density is 0.1 A/m$^2$ to 5 A/m$^2$.

2. The method for repairing the inner wall of the material through the localized electrodeposition by using the hybrid laser-electrochemical technology according to claim 1, wherein the workpiece to be repaired is a metal thin-walled tubular workpiece with a good thermal conductivity and has a wall thickness of 3 mm or less.

3. The method for repairing the inner wall of the material through the localized electrodeposition by using the hybrid laser-electrochemical technology according to claim 1, comprising the following steps:

step 1: drawing a motion path model according to graphics of a region to be repaired, and optimizing and importing the motion path model into a computer;

step 2: pretreating the inner surface and the outer surface of the workpiece to be repaired;

step 3: connecting the tool anode to a positive electrode of a direct-current pulse power supply and connecting the workpiece to be repaired to a negative electrode of the direct-current pulse power supply;

step 4: immersing the inner surface of the workpiece to be repaired and the tool anode in an electrodeposition solution, turning on the direct-current pulse power supply to form an electrochemical circuit between the workpiece to be repaired and the tool anode, and turning on a peristaltic pump to ensure a uniform concentration of the electrodeposition solution during the electrochemical reaction;

step 5: turning on a pulsed laser, so that the laser beam emitted by the pulsed laser is focused and irradiated on the outer surface of the workpiece to be repaired and a heat generated by the laser is transferred via a thermal conduction to the region to be repaired on the inner surface of the workpiece to be repaired, and inducing the localized electrodeposition in a corresponding region on an inner wall of the workpiece to be repaired by a regional thermal effect of the laser; and step 6: controlling, by a motion controller, a rotation of a tool anode work arm and a coordinated motion of an x-y-z three-axis motion platform to perform a three-dimensional rapid machining on the workpiece to be repaired according to the motion path.

4. A method for repairing the inner wall of the material through the localized electrodeposition by using the hybrid laser-electrochemical technology, wherein the method repairs a workpiece using a laser and an electrochemical reaction, a tool anode is arranged in a center of the workpiece, the tool anode is spaced from the workpiece, and a laser beam is focused on an outer surface of the workpiece to locally repair the inner wall, and the method comprises the following steps:

step 1: drawing a motion path model according to graphics of a region to be repaired, and optimizing and importing the motion path model into a computer;

step 2: pretreating an inner surface and the outer surface of the workpiece to be repaired;

step 3: connecting the tool anode to a positive electrode of a direct-current pulse power supply and connecting the workpiece to be repaired to a negative electrode of the direct-current pulse power supply;

step 4: immersing the inner surface of the workpiece to be repaired and the tool anode in an electrodeposition solution, turning on the direct-current pulse power supply to form an electrochemical circuit between the workpiece to be repaired and the tool anode, and turning on a peristaltic pump to ensure a uniform concentration of the electrodeposition solution during the electrochemical reaction;

step 5: turning on a pulsed laser, so that the laser beam emitted by the pulsed laser is focused and irradiated on the outer surface of the workpiece to be repaired and a heat generated by the laser is transferred via a thermal conduction to the region to be repaired on the inner surface of the workpiece to be repaired, and inducing the localized electrodeposition in a corresponding region on an inner wall of the workpiece to be repaired by a regional thermal effect of the laser; and step 6: controlling, by a motion controller, a rotation of a tool anode work arm and a coordinated motion of an x-y-z three-axis motion platform to perform a three-dimensional rapid machining on the workpiece to be repaired according to the motion path.

* * * * *